United States Patent [19]

Kozak

[11] Patent Number: 4,876,929

[45] Date of Patent: Oct. 31, 1989

[54] PORTABLE SCREW DRIVER HAVING FLEXIBLE EXTENSION SHAFT

[76] Inventor: Burton Kozak, 551 Clavey La., Highland Park, Ill. 60035

[21] Appl. No.: 244,334

[22] Filed: Sep. 15, 1988

[51] Int. Cl.[4] ..... B25B 13/46

[52] U.S. Cl. ..... 81/57.43; 81/177.6

[58] Field of Search ..... 81/57.43, 177.6

[56] References Cited

U.S. PATENT DOCUMENTS

| | | | |
|---|---|---|---|
| 2,501,217 | 3/1950 | Hawn | 81/177.6 X |
| 2,637,233 | 5/1953 | Hoffman | 81/57.43 |
| 2,796,101 | 6/1957 | Hasemann et al. | 81/177.6 X |
| 2,814,224 | 11/1957 | Allard | 81/57.43 |
| 2,814,322 | 11/1957 | Kupfrian | 81/177.6 X |
| 3,585,885 | 6/1971 | Carr | 81/177.6 X |
| 4,730,960 | 3/1988 | Lewis et al. | 81/177.6 X |

FOREIGN PATENT DOCUMENTS

| | | | |
|---|---|---|---|
| 872798 | 6/1942 | France | 81/177.6 |
| 1043735 | 11/1953 | France | 81/177.6 |
| 1274541 | 9/1960 | France | 81/57.43 |

*Primary Examiner*—James G. Smith

*Attorney, Agent, or Firm*—Wood, Dalton, Phillips, Mason & Rowe

[57] ABSTRACT

A cordless portable electric screwdriver having a chuck for normally holding a tool for rotary driven motion at one end thereof. The screwdriver includes a flexible extension shaft having a first end adapted to cooperate with the chuck and a second end adapted to hold the tool for rotary driven motion. The first end of the flexible extension shaft and the chuck have complementarily shaped non-circular cross-sections. The chuck has an axis and is adapted to receive the first end of the flexible shaft by means of axial insertion of the shaft into the chuck with the non-circular cross-sections in rotationally aligned relationship and the chuck is also adapted to hold the first end of the flexible extension shaft for rotary driven motion of the shaft. The second end of the flexible extension shaft and the tool have complementarily shaped non-circular cross-sections. The screwdriver is operable to drive the tool by reason of the second end of the flexible shaft holding the tool for rotary driven motion thereof. With this arrangement, the flexible extension shaft normally is disposed so as to be substantially entirely coaxial with the chuck but is universally deflectable relative to the axis of the chuck so as to position the second end of the shaft and the tool at an acute angle relative thereto.

8 Claims, 2 Drawing Sheets

PORTABLE SCREW DRIVER HAVING FLEXIBLE EXTENSION SHAFT

FIELD OF THE INVENTION

The present invention generally relates to cordless portable electric screwdrivers and, more particularly, to a cordless portable electric screwdriver having a flexible extension shaft.

BACKGROUND OF THE INVENTION

Cordless portable electric screwdrivers have become very popular because they allow a workman to easily complete various tasks without manual effort or the hindrance of a power cord. In order to obtain optimum benefit, the workman has many tools for use with the cordless portable electric screwdriver including various types and sizes of drill bits, screwdriver tips and the like. Each tool must be fashioned to connect to a chuck which normally positions the tool in close proximity to the relatively large casing of the screwdriver. As a result, cordless portable electric screwdrivers have been rendered relatively ineffective for use in confined, difficult-to-reach locations.

In this connection, cordless portable electric screwdrivers have generally been relatively long. As previously mentioned, they have also generally had a casing surrounding the motor which is quite large in relation to the tool, i.e., drill bits, screwdriver tips and the like. For this reason, it has been difficult to utilize a cordless portable electric screwdriver in areas of limited access.

The present invention is directed to overcoming the above-stated problems and accomplishing the stated objects by providing a unique portable electric screwdriver having a flexible extension shaft.

SUMMARY OF THE INVENTION

Accordingly, the present invention is directed to a cordless portable electric screwdriver having a chuck for normally holding a tool for rotary driven motion at one end thereof. The screwdriver includes a flexible extension shaft having a first end adapted to cooperate with the chuck and a second end adapted to hold the tool for rotary driven motion. The first end of the flexible extension shaft and the chuck have complementarily shaped non-circular cross-sections. The chuck has an axis and is adapted to recieve the first end of the flexible shaft by means of axial insertion of the shaft into the chuck with the non-circular cross-sections in rotationally aligned relationship and the chuck also includes means for holding the first end of the flexible extension shaft for rotary driven motion of the shaft. The second end of the flexible extension shaft and the tool also have complementarily shaped non-circular cross-sections. The screwdriver is operable to drive the tool by reason of the second end of the flexible shaft including means for holding the tool for rotary driven motion thereof. With this arrangement, the flexible extension shaft normally is disposed so as to be substantially entirely coaxial with the chuck but is universally deflectable relative to the axis of the chuck so as to position the second end of the shaft and the tool at an acute angle relative thereto.

As will be appreciated, the tool is rotary driven by the cordless portable electric screwdriver through the flexible extension shaft. For this purpose, one of the first and second ends of the flexible extension shaft preferably includes a generally cylindrical body portion terminating in a male hex shank and the other of the first and second ends of the flexible extension shaft preferably includes a cylindrical body portion terminating in a female hex shank-receiving opening. Between the first and second ends, the flexible extension shaft advantageously includes a plurality of concentric coil springs in tightly wound adjacent relation.

Further, the concentric coil springs are preferably secured to the generally cylindrical body portions of the first and second ends of the flexible extension shaft to accommodate the universal deflection of the shaft relative to the axis of the chuck. A flexible sleeve is then advantageously disposed about the concentric coil springs. More specifically, the flexible sleeve preferably includes cylindrical fittings secured thereto at opposite ends thereof so as to define a shoulder internally of each of the fittings which are adapted to receive one of the cylindrical body portions therein.

In the preferred embodiment, the cylindrical body portions are spaced apart by a distance greater than the distance between the shoulders in the cylindrical fittings to permit limited axial movement of the cylindrical body portions and the concentric coil springs relative to the cylindrical fittings and the flexible sleeve. A shaft biasing coil spring is then advantageously disposed about the concentric coil springs of the flexible extension shaft. More specifically, the shaft biasing coil spring is disposed between the shoulder in one of the cylindrical fittings and the corresponding one of the cylindrical body portions to normally bias the other of the cylindrical body portions into engagement with the shoulder in the other of the cylindrical fittings.

Other objects, advantages and features of the present invention will become apparent from the following specification taken in conjunction with the accompanying drawings.

DETAILED DESCRIPTION OF THE PREFERRED EMBODIMENT

Figures 1, 1A, 1B:
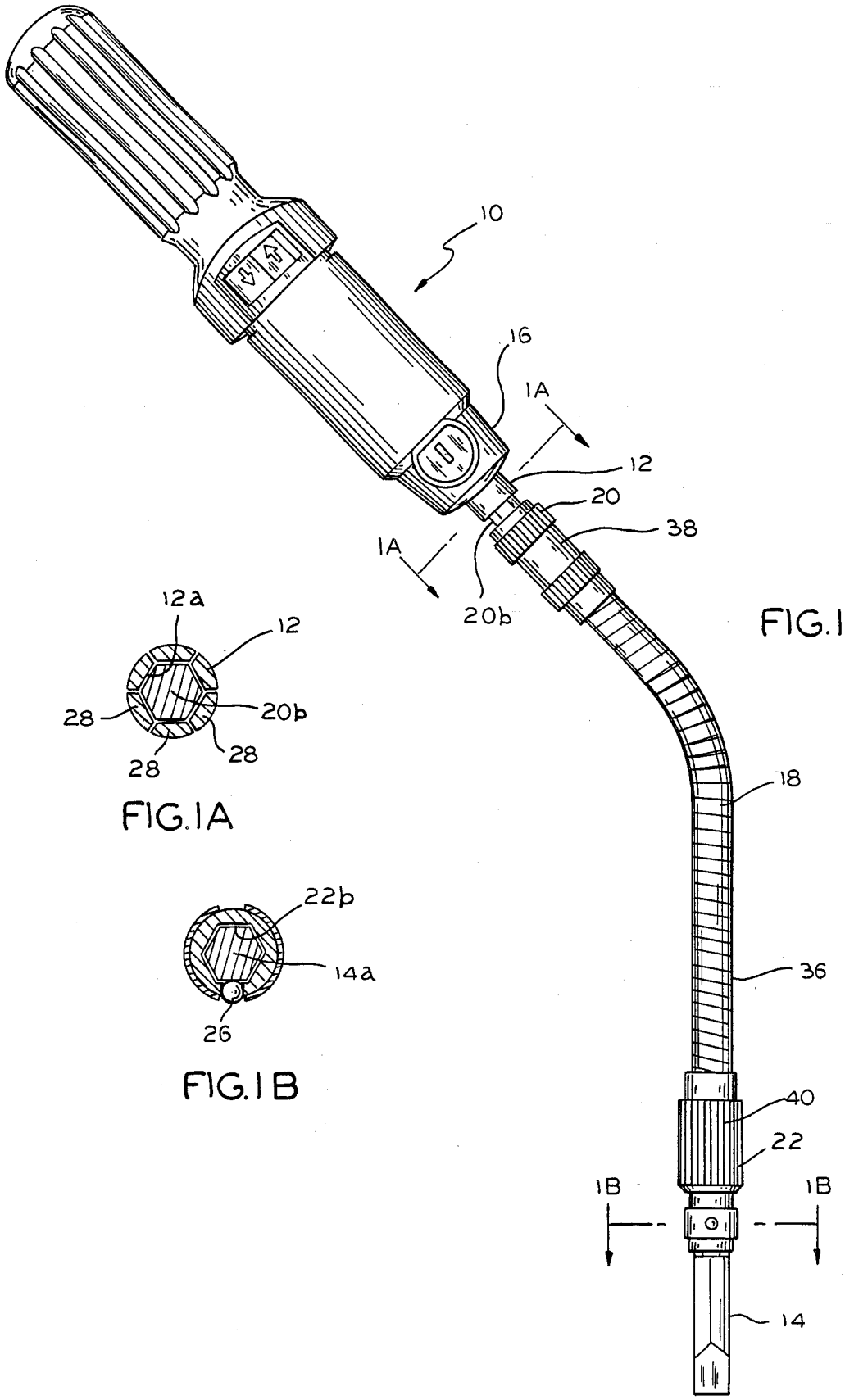
FIG. 1 is perspective view of a portable electric screwdriver having a flexible extension shaft in accordance with the present invention.
FIG. 1A is a transverse cross-sectional view of the screwdriver and flexible extension shaft taken on the line 1A1A of FIG. 1.
FIG. 1B is a transverse cross-sectional view of the flexible extension shaft and a tool taken on the line 1B1B of FIG. 1.

Referring to the drawings, and first to FIG. 1, the reference numeral 10 designates generally a cordless portable electric screwdriver having a chuck 12 for normally holding a tool 14 for rotary driven motion at one end 16 thereof. The screwdriver 10 includes a flexible extension shaft 18 having a first end 20 adapted to cooperate with the chuck 12 and a second end 22 adapted to hold the tool 14 for rotary driven motion. The first end 20 of the flexible extension shaft 18 and the chuck 12 have complementarily shaped non-circular cross-sections (see FIG. 1A). The chuck 12 has an axis 24 and is adapted to receive the first end 20 of the flexible extension shaft 18 by means of axial insertion of the shaft into the chuck with the non-circular cross-sections in rotationally aligned relationship and the chuck 12 also includes means for holding the first end 20 of the flexible extension shaft 18 for rotary driven motion of the shaft. The second end 22 of the flexible extension shaft 18 and the tool 14 also have complementarily shaped non-circular crosss-sections (see FIG. 1B). The screwdriver 10 operates such that the second end 22 of the flexible extension shaft 18 includes means for holding the tool 14 for rotary driven motion thereof. With this arrangement, the flexible extension shaft 18 normally is disposed so as to be substantially entirely coaxial with the chuck 12 and is universally deflectable relative to the axis 24 of the chuck 12 so as to position the second end 22 of the shaft 18 and the tool 14 at an cute angle relative to the axis 24 of the chuck 12 (see in particular FIG. 1).

As will be appreciated by referring to FIG. 1, the tool 14 is rotary driven by the cordless portable electric screwdriver 10 through the flexible extension shaft 18. It will also be appreciated that one of the first and second ends of the flexible extension shaft 18 such as the end 20 includes a generally cylindrical body portion such as **20*a* terminating in a male hex shank such as 20*b* with the other of the first and second ends such as 22 including a generally cylindrical body portion such as 22*a* terminating in a female hex shank-receiving opening such as 22*b*. It will further be appreciated that the chuck 12 includes a female hex shank-receiving opening 12*a* which, together with the male hex shank 20*b*, defines first of the previously described complementarily shaped non-circular cross-sections and the tool 14 includes a male hex shank 14*a* which, together with the female hex shank-receiving opening 22*b*, defines the second of the previously described complementarily shaped non-circular cross-sections. With this arrangement, the first end 20 of the flexible extension shaft 18 is adapted for insertion into the chuck 12 and the tool 14 is adapted for insertion into the second end 22 of the flexible extension shaft 18**.

Figure 2:
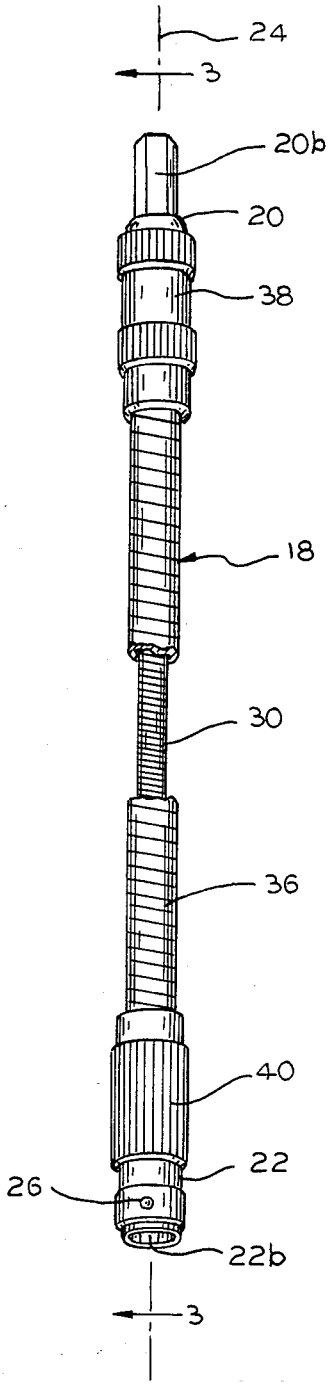
FIG. 2 is a partial perspective view of the flexible extension shaft untilized in the screwdriver illustrated in FIG. 1.

Referring to FIGS. 1 and 2, the means for holding the tool 14 for rotary driven motion includes a detent 26 associated with the female hex shank-receiving opening **22*b* in the second end 22 of the flexible extension shaft 18. In like fashion, the means for holding the first end 20 of the flexible extension shaft 18 for rotary driven motion may include a plurality of fingers 28 associated with the female hex shank-receiving opening 12*a* in the chuck 12**.

Figure 3:
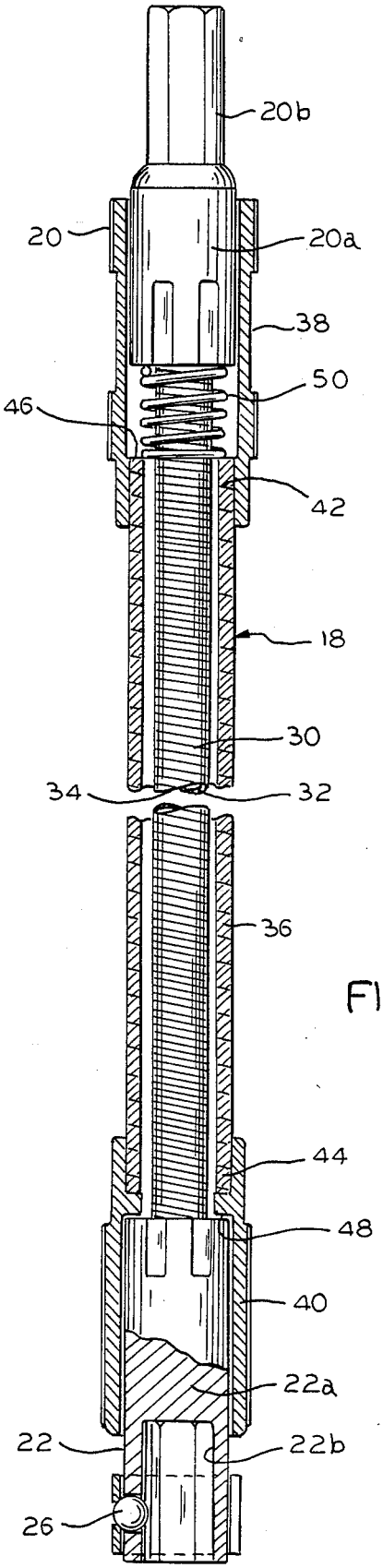
FIG. 3 is a longitudinal cross-sectional view of the flexible extension shaft taken on the line 3—3 of FIG. 2.

Referring to FIGS. 2 and 3, the flexible extension shaft 18 includes a plurality of concentric coil springs 30,32,34 in tightly wound adjacent relation extending between and secured to the generally cylindrical body portions **20*a* and 22*a* of the first and second ends 20 and 22 of the shaft 18 to accommodate universal deflection of the shaft relative to the axis 24 of the chuck 12. It will also be seen that a flexible sleeve 36 is disposed about the concentric coil springs 30,32,34. As illustrated, the flexible sleeve 36 has cylindrical fittings 38 and 40 secured thereto at opposite ends 42 and 44 thereof to receive one of the cylindrical body portions 20*a* and 22*a* therein and the flexible sleeve 36 and cylindrical fittings 38 and 40 define shoulders 46 and 48 internally of each of the fittings 38 and 40 to form stops for the cylindrical body portions 20*a* and 22*a***.

More specifically, the cylindrical body portions **20*a* and 22*a* are spaced apart by a distance greater than the distance between the shoulders 46 and 48 in the cylindrical fittings 38 and 40 to permit limited axial movement of the cylindrical body portions 20*a* and 22*a* and the concentric coil springs 30,32,34 relative to the cylindrical fittings 38 and 40 and the flexible sleeve 36. With this construction, a shaft biasing coil spring 50 is disposed about the concentric coil springs 30,32,34 of the flexible extension shaft 18 between the shoulder such as 48 in one of the cylindrical fittings such as 40 in the corresponding one of the cylindrical body portions such as 22*a* to normally bias the other of the cylindrical body portions such as 20*a* into engagement with the shoulder such as 46 in the other of the cylindrical fittings such as 38**.

As should now be appreciated, the cordless portable electric screwdriver 10 when utilized with the unique flexible extension shaft 18 is extremely versatile. The fact that it is universally deflectable relative to the axis 24 of the chuck 12 accommodates use of the screwdriver 10 in hard-to-reach or limited access areas since the tool 14 can be disposed at an acute angle relative to the axis 24 of the chuck 12 by deflecting or bending the flexible extension shaft 18 such as illustrated in FIG. 1. In this connection, the flexible sleeve 36 permits the user to grip the flexible extension shaft 18 to hold it in a deflected position during use without exposure to the moving parts.

In other words, the concentric coil springs 30,32,34 are rotating internally of the flexible sleeve 36 and the difference in distance between the cylindrical body portions **20*a* and 22*a* and the cylindrical fittings 38 and 40** accommodate the arc into which the flexible extension shaft is oftentimes advantageously deflected and held during use of the screwdriver.

While in the foregoing there has been set forth a preferred embodiment of the invention, it is to be understood that the invention is only to be limited by the spirit and scope of the appended claims.

I claim:

1. In a cordless portable electric screwdriver having a chuck for normally holding a tool for rotary driven motion at one end thereof, the improvement comprising:

a flexible extension shaft having a first end adapted to cooperate with said chuck and a second end adapted to hold said tool for rotary driven motion, said first end of said flexible extension shaft and said chuck having complemetarily shaped non-circular cross-sections, said chuck having an axis and being adapted to receive said first end of said flexible extension shaft by means of axial insertion of said shaft into said chuck with said non-circular cross-sections in rotationally aligned relationship and said chuck also including means for holding said first end of said flexible extension shaft for rotary driven motion of said shaft, said second end of said flexible extension shaft and said tool having complementarily shaped non-circular cross-sections, said second end of said flexible extension shaft including means for holding said tool for rotary driven motion thereof;

said flexible extension shaft normally bing disposed so as to be substantially entirely coaxial with said chuck, said flexible extension shaft being universally deflectable relative to said axis of said chuck so as to position said second end of said shaft and said tool at an acute angle relative to said axis of said chuck, said tool being rotary driven by said cordless portable electric screwdriver through said flexible extension shaft;

said flexible extension shaft including a plurality of concentric coil springs in tightly wound adjacent relation extending between and secured to generally cylindrical body portions at said first and second ends of said shaft to accommodate universal deflection of said shaft relative to said axis of chuck, and including a flexible sleeve disposed about said concentric coil springs, said flexible sleeve having cylindrical fittings secured thereto at opposite ends thereof so as to define a shoulder internally of each of said fittings, said cylindrical fittings each being adapted to receive one of said cylindrical body portions therein, said cylindrical body portions being spaced apart by a distance greater than the distance between said shoulders in said cylindrical fittings to permit limited axial movement of said cylindrical body portions and said concentric coil springs relative to said cylindrical fittings and said flexible sleeve.

2. The cordless portable electric screwdriver as defined in claim 1 wherein said generally cylindrical body portion at said first end of said flexible extension shaft terminates in a male hex shank and said chuck includes a female hex shank-receiving opening defining said complementarily shaped non-circular cross-sections.

3. The cordless portable electric screwdriver as defined in claim 2 wherein said means for holding said first end of said flexible extension shaft for rotary driven motion of said shaft includes a plurality of fingers associated with said chuck.

4. The cordless portable electric screwdriver as defined in claim 1 wherein said generally cylindrical body portion at said second end of said flexible extension shaft terminates in a female hex shank-receiving opening and said tool includes a male hex shank defining said complementarily shaped non-circular cross-sections.

5. The cordless portable electric screwdriver as defined in claim 4 wherein said means for holding said tool for rotary driven motion includes a detent associated with said female hex shank-receiving opening in said second end of said flexible extension shaft.

6. The cordless portable electric screwdriver as defined in claim 1 including a shaft biasing coil spring disposed about said concentric coil springs of said flexible extension shaft, said shaft biasing coil spring being disposed between said shoulder in one of said cylindrical fittings and the corresponding one of said cylindrical body portions to normally bias the other of said cylindrical body portions into engagement with said shoulder in the other of said cylindrical fittings.

7. In a cordless portable electric screwdriver having a chuck for normally holding a tool for rotary driven motion at one end thereof, the improvement comprising:

a flexible extension shaft having a first end adapted to cooperate with said chuck and a second end adapted to hold said tool for rotary driven motion, said first end of said flexible extension shaft and said chuck having complementarily shaped non-circular cross-sections, said chuck having an axis and being adapted to receive said first end of said flexible extension shaft by means of axial insertion of said shaft into said chuck with said non-circular cross-sections in rotationally aligned relationship and said chuck also including means for holding said first end of said flexible extension shaft for rotary driven motion of said shaft, said second end of said flexible extension shaft and said tool having complementarily shaped non-circular cross-sections, said second end of said flexible extension shaft including means for holding said tool for rotary driven motion thereof;

said flexible extension shaft normally being disposed so as to be substantially entirely coaxial with said chuck, said flexible extension shaft being universally deflectable relative to said axis of said chuck so as to position said second end of said shaft and said tool at an acute angle relative to said axis of said chuck, said tool being rotary driven by said cordless portable electric screwdriver through said flexible extension shaft;

one of said first end of said flexible extension shaft and said chuck including a male hex shank and the other of said first end of said flexible extension shaft and said chuck including a female hex shank-receiving opening defining said complementarily shaped non-circular cross-sections;

one of said second end of said flexible extension shaft and said tool including a female hex shank-receiving opening and the other of said second end of said flexible extension shaft and said tool including a male hex shank defining said complementarily shaped non-circular cross-sections;

one of said first and second ends of said flexible extension shaft including a generally cylindrical body portion terminating in said male hex shank and the other of said first and second ends of said flexible extension shaft including a generally cylindrical body portion terminating in said female hex shank-receiving opening;

said flexible extension shaft including a plurality of concentric coil springs in tightly wound adjacent relation extending between and secured to said generally cylindrical body portions of said first and second ends of said shaft to accommodate universal deflection of said shaft relative to said axis of said chuck; and a flexible sleeve disposed about said concentric coil springs, said flexible sleeve having cylindrical fittings secured thereto at opposite ends thereof so as to define a shoulder internally of each of said fittings, said cylindrical fittings each being adapted to receive one of said cylindrical body portions therein;

said cylindrical body portions being spaced apart by a distance greater than the distance between said shoulders and said cylindrical fittings to permit limited axial movement of said cylindrical body portions and said concentric coil springs relative to said cylindrical fittings and said flexible sleeve.

8. The cordless portable electric screwdriver as defined in claim 7 including a shaft biasing coil spring disposed about said concentric coil springs of said flexible extension shaft, said shaft biasing coil spring being disposed between said shoulder in one of said cylindrical fittings and the corresponding one of said cylindrical body portions to normally bias the other of said cylindrical body portions into engagement with said shoulder in the other of said cylindrical fittings.

* * * * *